US005085319A

United States Patent [19]

Wellman et al.

[11] Patent Number: 5,085,319

[45] Date of Patent: Feb. 4, 1992

[54] BOW AND ARROW STORAGE DEVICE

[76] Inventors: Gerald L. Wellman; Terri A. Wellman, both of 5883 Miller Rd., Hillman, Mich. 49746

[21] Appl. No.: 704,189

[22] Filed: May 22, 1991

[51] Int. Cl.[5] ..... B65D 85/20

[52] U.S. Cl. ..... 206/315.11; 206/317; 224/916; 124/25.7; 124/41.1

[58] Field of Search ..... 206/315.11, 315.1, 317; 224/916; 124/41.1, 25.7

[56] References Cited

U.S. PATENT DOCUMENTS 2,964,166 12/1960 Lehner et al. ..... 206/315.1 X
3,286,961 11/1966 Mandolare ..... 124/25.7 X
3,465,928 9/1969 Osterholm ..... 224/210
3,696,978 10/1972 Gentellalli ..... 206/315.11
4,681,219 7/1987 Kitchens ..... 206/315.11

*Primary Examiner*—William I. Price
*Attorney, Agent, or Firm*—H. Jay Spiegel

[57] ABSTRACT

A bow and arrow storage device is disclosed including a plurality of chambers each of which is sized and configured to hold a multiplicity of arrows. The device further includes two elongated bars having ends which overhang the arrow storage chambers to allow hanging of bows on them. A central divider separating the storage chambers from one another conveniently includes drink container receptacles.

7 Claims, 2 Drawing Sheets

BOW AND ARROW STORAGE DEVICE

BACKGROUND OF THE INVENTION

The present invention relates to a bow and arrow storage device.

In the prior art, devices designed to be used to store bows and/or arrows are known. However, Applicants are unaware of any such device including all of the features, structures and functions of the present invention.

The following prior art are known to Applicants:

U.S. Pat. No. 2,986,187 to Gazzara discloses an arrow holding device including a container with a plurality of clips each of which is designed to hold a single arrow. The present invention differs from the teachings of this device as disclosing a floor standing device designed to hold bows and arrows in a unique way.

U.S. Pat. No. 3,465,928 to Osterholm discloses an arrow quiver having clips designed to allow storage of a bow. The present invention differs from the teachings of Osterholm as including elongated members designed to allow hanging of a bow thereon. Furthermore, the present invention is intended to be floor supported and includes a multiplicity of arrow storing chambers as well as drink container receptacles.

U.S. Pat. No. 3,696,978 to Gentellalli discloses an adjustable quiver intended to store a plurality of arrows and which may be provided with shoulder straps. The present invention differs from the teachings of this patent as including floor standing structure, a multiplicity of arrow storage chambers, devices designed to allow hanging of bows thereon and drink container receptacles.

SUMMARY OF THE INVENTION

The present invention relates to a bow and arrow storage device. The present invention includes the following interrelated objects, aspects and features:

(a) In a first aspect, the present invention includes a base intended to support the device on a ground surface. The base preferably includes two elongated supporting members.

(b) Mounted on the support members is a housing having a multiplicity of arrow storage chambers formed therein. Additionally, a central divider is provided which preferably includes two drink container receptacles.

(c) On top of the housing, two elongated bow support bars are provided which allow hanging of bows thereon. The bow support bars may either be mounted above the upper extremity of the storage chambers or may be mounted slightly recessed.

As such, it is a first object of the present invention to provide a bow and arrow storage device.

It is a further object of the present invention to provide such a device including a base consisting of two elongated supporting members.

It is a further object of the present invention to provide such a device including a multiplicity of storage chambers for arrows and bow support bars intended to support a plurality of bows.

It is a yet further object of the present invention to provide such a device which includes drink container receptacles.

These and other objects, aspects and features of the present invention will be better understood from the following detailed description of the preferred embodiment when read in conjunction with the appended drawing figures.

SPECIFIC DESCRIPTION OF THE PREFERRED EMBODIMENT

Figure 1:
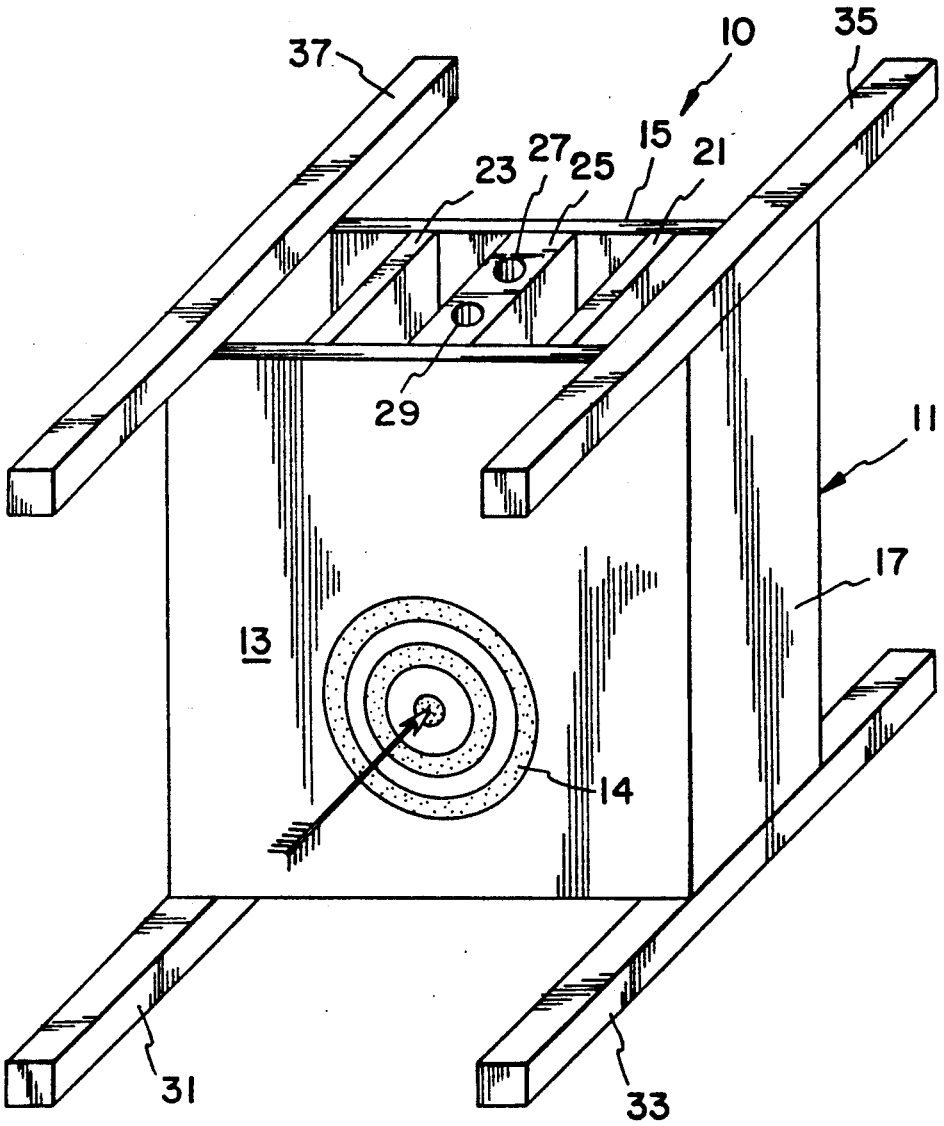
FIG. 1 shows a perspective view of the present invention.

With reference to the figures, the present invention is generally designated by the reference numeral 10 and includes a generally rectangular cubic housing 11 having a front wall 13, a rear wall 15 and side walls 17, 19. The front wall 13 may, if desired, have a logo 14 which consists of a simulated target having an arrow in the bullseye thereof.

Figure 2:
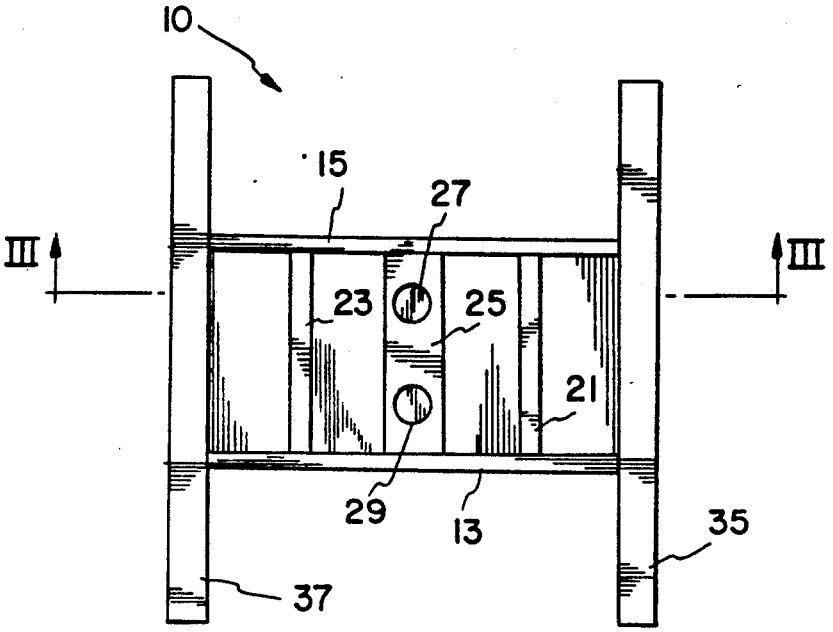
FIG. 2 shows a top view of the present invention.
Figure 3:
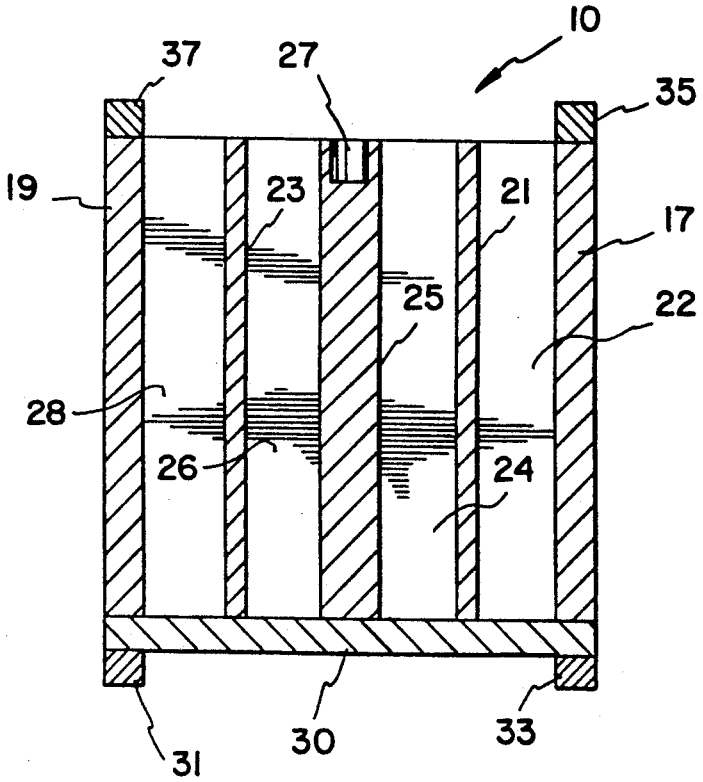
FIG. 3 shows a cross-sectional view along the line III—III of FIG. 2.

As shown in the figures, the housing 11 is divided into chambers 22, 24, 26 and 28 by dividers 21, 23 and a central divider 25. As best seen in FIGS. 2 and 3, the central divider 25 includes drink container recesses 27, 29.

With reference to FIGS. 1 and 3, the housing 11 includes a bottom 30 which encloses the chambers 22, 24, 26 and 28. The device 10 is supported on support means consisting of elongated supporting members 31, 33 which extend beyond the front and rear walls 13, 15 so as to provide sufficient stability for the device 10.

Furthermore, the device includes bow support bars 35 and 37 which are both elongated and extend well beyond the front wall 13 and rear wall 15 of the housing. These support bars are each designed to support, in a hanging fashion, a plurality of bows. Thus, a single bow may be supported on either one of the supports 35 or 37 or by using both supports together as desired. The supports 35, 37 are sufficiently long enough to allow storing of a multiplicity of bows on each one.

As particularly shown in FIGS. 1 and 3, the bow support bar 35 is recessed within the device 10 in such a manner that a top wall thereof is flush with the tops of the openings of the chambers 22, 24, 26 and 28. The support bar 37 is shown mounted on top of the housing 11. The differing manners of mounting of the support bars 35 and 37 are intended to exemplify two alternative modes of mounting of the support bars 35, 37 on the housing 11.

The operation of the present invention should be self evident in light of the above description. Each of the chambers 22, 24, 26 and 28 is sized to allow receipt of the multiplicity of arrows. Each of the support bars 35, 37 is sized and configured to receive one or more bows. The drink receptacles 27, 29 are sized to receive either cups or drink containers.

In the preferred embodiment of the present invention, the device 10 is made of wood and/or particle board. Alternatively, for strength, metallic components may be employed. Furthermore, the support bars 35, 37 may be attached to the housing 11 in any suitable manner such as, for example, through the use of nails, screws, gluing or some combination thereof.

As such, an invention has been disclosed in terms of a preferred embodiment thereof which fulfills each and every one of the objects of the present invention as set forth above and provides a new and useful bow and arrow storage device of great novelty and utility. Of course, various changes, modifications and alterations in the teachings of the present invention may be contemplated by those skilled in the art without departing from the intended spirit and scope thereof.

As such, it is intended that the present invention only be limited by the terms of the appended claims.

We claim:

1. A bow and arrow storage device, comprising:

a) a housing having a plurality of chambers;

b) said housing being supported on a ground surface by support means; and c) at least one bow support comprising an elongated bar mounted on said housing and overhanging two sides of said housing.

2. The invention of claim 1, wherein said housing is generally rectangular cubic.

3. The invention of claim 1, wherein said plurality of chambers comprises two chambers separated by a receptacle holder.

4. The invention of claim 1, wherein said support means comprises two elongated supporting members which extend beyond said housing two sides to provide stability.

5. The invention of claim 1, comprising two bow supports.

6. The invention of claim 1, further including a target design on one of said two sides.

7. The invention of claim 3, wherein said receptacle holder includes recesses for two receptacles.

* * * * *